United States Patent [19]

Winick

[11] Patent Number: 4,702,715

[45] Date of Patent: Oct. 27, 1987

[54] AUTOMATIC EMERGENCY RESCUE APPARATUS

[76] Inventor: Alan L. Winick, 4 Oak Ridge Park, Westport, Conn. 06880

[21] Appl. No.: 871,251

[22] Filed: Jun. 6, 1986

[51] Int. Cl.[4] ..... B63C 9/00

[52] U.S. Cl. ..... 441/80; 441/6; 441/30; 441/88

[58] Field of Search ..... 441/80, 81, 84, 85, 441/88, 89, 90, 92–95, 99, 6, 11, 30, 42; 114/190

[56] References Cited

U.S. PATENT DOCUMENTS

| | | | |
|---|---|---|---|
| 3,675,257 | 7/1972 | Haglund et al. | 441/80 |
| 3,696,453 | 10/1972 | Harris et al. | 441/80 |
| 3,754,291 | 8/1973 | Harris et al. | 441/80 |
| 3,810,146 | 5/1974 | Lieb | 441/80 X |
| 3,945,067 | 3/1976 | Salvarezza | 441/80 |
| 4,079,364 | 3/1978 | Antenore | 441/80 X |
| 4,155,132 | 5/1979 | Lee | 441/80 |
| 4,228,556 | 10/1980 | Searls | 441/80 X |
| 4,305,143 | 12/1981 | Simms et al. | 441/80 X |
| 4,498,879 | 2/1985 | Burr | 441/80 |

FOREIGN PATENT DOCUMENTS

| | | | |
|---|---|---|---|
| 2551020 | 3/1985 | France | 441/84 |
| 135397 | 7/1985 | Japan | 441/80 |

*Primary Examiner*—Joseph F. Peters, Jr.
*Assistant Examiner*—Paul E. Salmon
*Attorney, Agent, or Firm*—Dennis M. Flaherty

[57] ABSTRACT

An automatic rescue apparatus for deploying a flotation device. The unit can be mounted vertically on the rail of a vessel or horizontally on the deck. The rescue apparatus has a life ring, a launcher housing containing a radio receiver and a trigger device and incorporating a life ring launching arm, a housing containing a collapsed inflatable marker buoy and a $CO_2$ inflation assembly, and a portable battery-powered transmitter worn by an individual on a vessel. Ejection and resulting inflation of the marker buoy as well as simultaneous deployment of the life ring are actuated by a radio signal received from the transmitter worn by the overboard person.

13 Claims, 10 Drawing Figures

AUTOMATIC EMERGENCY RESCUE APPARATUS

FIELD OF THE INVENTION

The invention relates to an automatic rescue apparatus for deploying a flotation device in response to a person falling overboard from a vessel.

BACKGROUND OF THE INVENTION

In man-overboard situations aboard boats and similar vessels, it is essential that a flotation device be provided to the victim in the shortest possible time. Equally if not more important is the placement of a marker in the water as close as possible to the point of entry of the victim. As a vessel can generally be expected to be in motion away from the point of entry, speed in deploying a marker can be a life-or-death matter. In the present invention, the immersion in water of a portable transmitter causes a radio signal to be sent to the vessel, resulting in the instantaneous deployment of rescue devices from the vessel as well as the triggering of an alarm on board. Prior art rescue devices have had disadvantages including: (a) delay in deployment of the flotation device caused by human reaction time; (b) gravity deployment of flotation devices requiring vertical or near-vertical mounting of the device on the vessel; and (c) the requirement that portable transmitters be attached to articles of clothing such as a shirt or jacket, which the individual, especially a recreational boater, may not be wearing at the time he or she falls overboard.

SUMMARY OF THE INVENTION

The present invention eliminates delay caused by human reaction time and reduces the time between the man-overboard event and the deployment of rescue devices to a minimum. Because the present invention imparts an ejecting force to the rescue devices and does not rely on gravity for this purpose, the unit can be mounted vertically on the rail of a vessel or horizontally on the deck. The portable transmitter in accordance with the present invention is worn as part of a necklace and need not be attached to any article of clothing.

The rescue apparatus in accordance with the invention is composed of a horseshoe-shaped life ring, a launcher housing containing a radio receiver and a trigger device and incorporating a life ring launching arm; a housing containing and acting as a weighted base for a collapsed inflatable marker buoy and a $CO_2$ inflation assembly; and a portable battery-powered transmitter which is worn by an individual on a vessel.

The launcher housing is attached to the rail or deck of the vessel. The marker buoy housing is releasably attached to the launcher housing and in this position also retains the life ring against the launching arm in the stowed position on the launcher housing. The launcher housing contains the radio receiver and a release mechanism for the life ring and marker buoy. Ejection and resulting inflation of the marker buoy as well as simultaneous deloyment of the life ring are actuated by a radio signal received from the transmitter worn by the victim in the water. In the preferred embodiment of the invention, ancillary rescue devices such as lights, whistle, dye marker, and a drogue are contained in the marker buoy housing and are released upon deployment of the marker buoy.

BRIEF DESCRIPTION OF THE DRAWINGS

The invention will be described in detail with reference to the following drawings.

DETAILED DESCRIPTION OF THE PREFERRED EMBODIMENT

The structure of the rescue apparatus will now be described with reference to the drawings.

Figure 5:
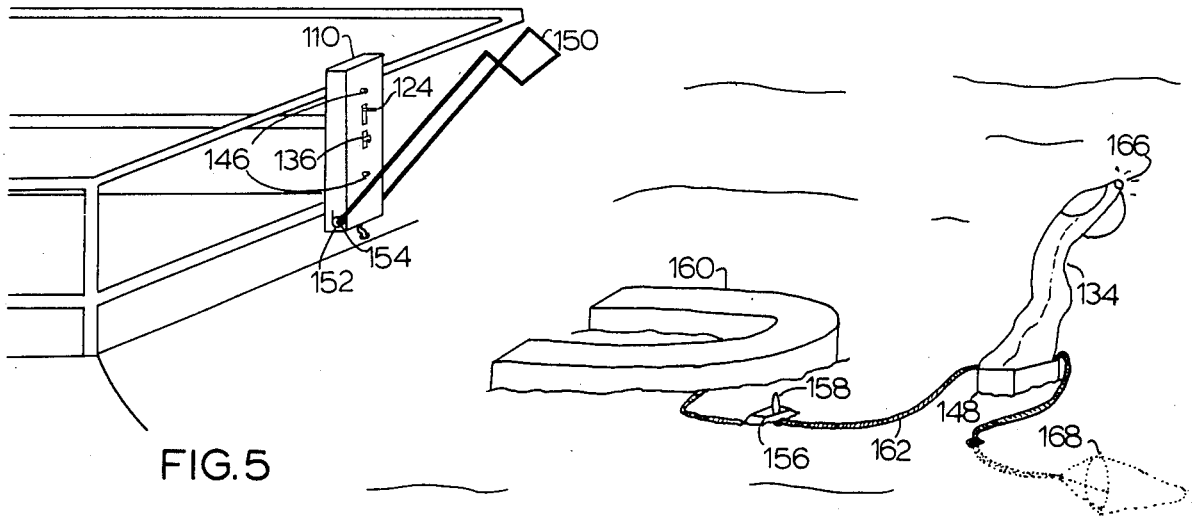
FIG. 5 is a perspective view of the apparatus in the deployed mode with the marker buoy nearing complete inflation.

FIG. 5 shows the launcher housing 110 without the life ring 160 and without the marker buoy housing 148. Launcher housing 110 is securely attached to some part of the vessel, for example, a handrail at the stern of the vessel. A launcher arm 150 is pivotably mounted on the launcher housing 110 at pivot point 152. Torsional springs 154 urge the launcher arm 150 into rotation away from the launcher housing. As clearly depicted in FIG. 5, two alignment pins 146, arm 124 and retaining hook 136 all protrude from the launcher housing. In place of the two alignment pins 146, any other functionally equivalent support members could be used. In place of retaining hook 136, any other functionally equivalent latching means could be used. These elements will be described in greater detail in connection with the discussion of FIGS. 6–8.

Figure 3:
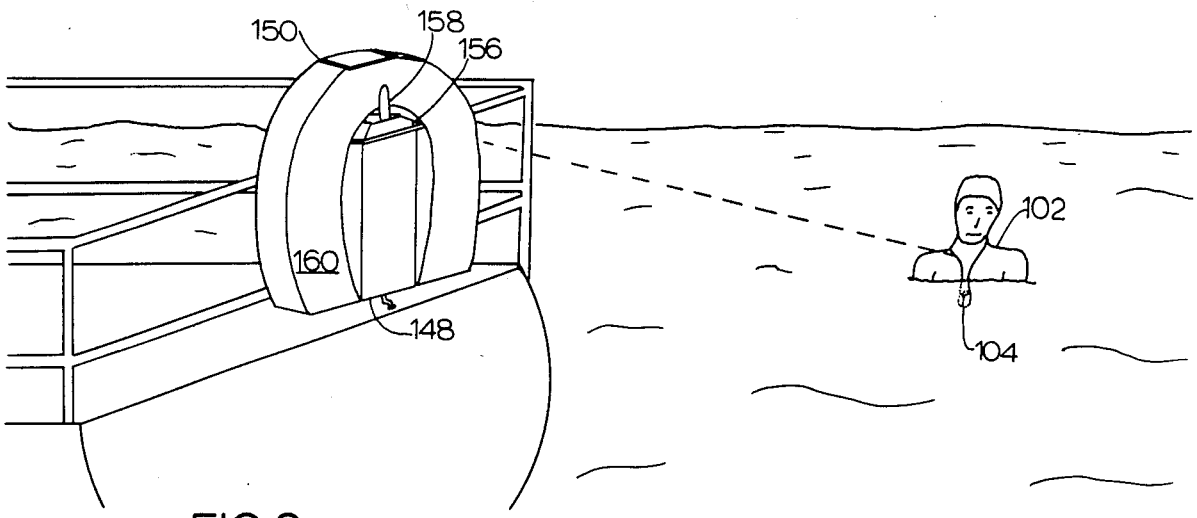
FIG. 3 is a perspective view of the apparatus in the stowed position with an individual having just entered the water.
Figure 4:
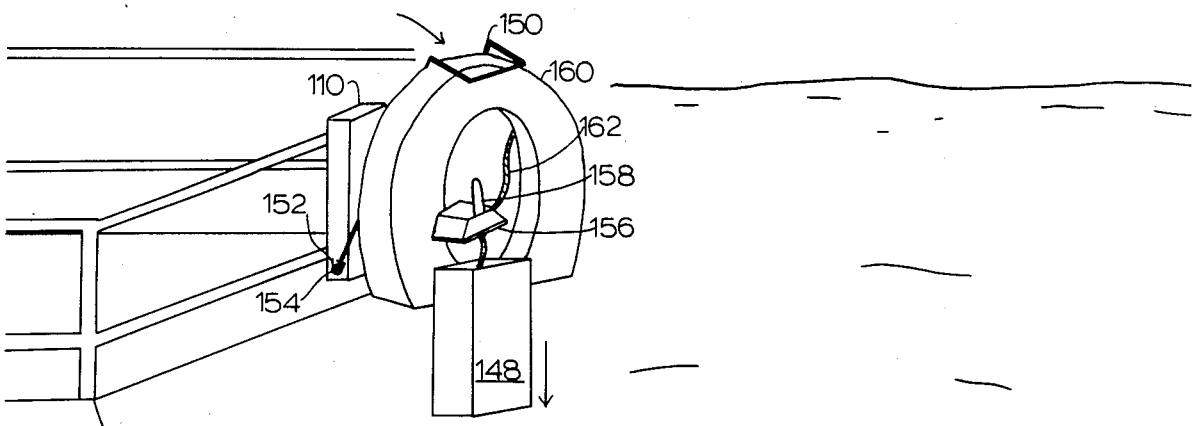
FIG. 4 is a perspective view of the apparatus in the partially deployed state.

FIG. 3 shows the elements which are coupled to the launcher housing in the ready condition. As will be described below, marker buoy housing 148 is held in place on the launcher housing by the alignment pins 146 and the retaining hook 136. A weather cap 156 is mounted on the marker buoy housing. A tongue 158 (or other functionally equivalent means) is rigidly connected to the weather cap 156 and extends in a generally vertical direction. The life ring 160 is seated on the marker buoy housing 148. The horseshoe shape of the life ring prevents it from falling off the marker buoy housing in a lateral direction, and the tongue 158 prevents the life ring from falling off in the direction away from the launcher housing. Vertical displacement of the life ring is prevented by the latching extension of the launcher arm 150.

As best seen in FIG. 5, the life ring 160, the weather cap 156, the marker buoy housing 148, and optionally a drogue 168 are serially connected by line 162.

Figure 6:
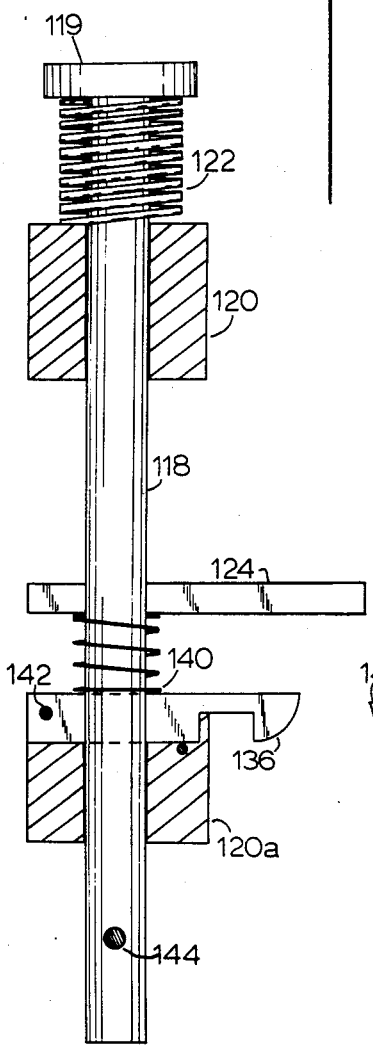
FIG. 6 is a side sectional view of the trigger device in the stowed position.
Figure 7:
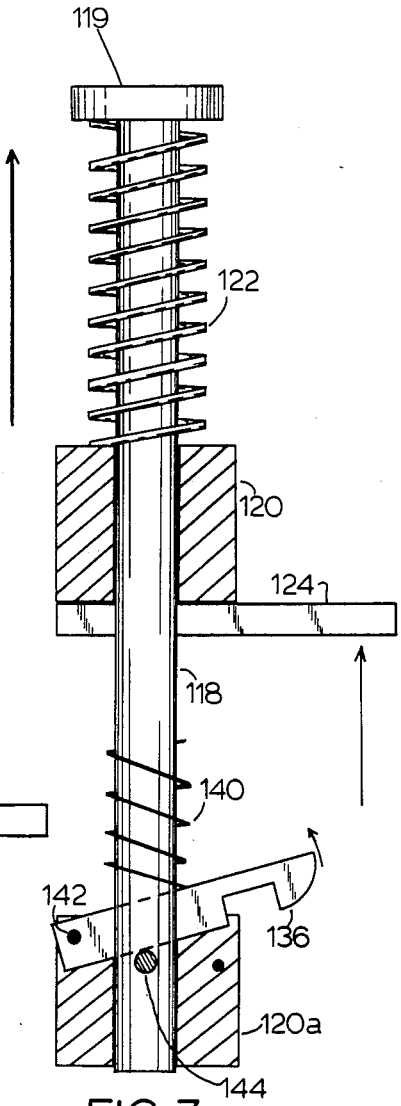
FIG. 7 is a side sectional view of the trigger device in the operative mode.
Figure 8:
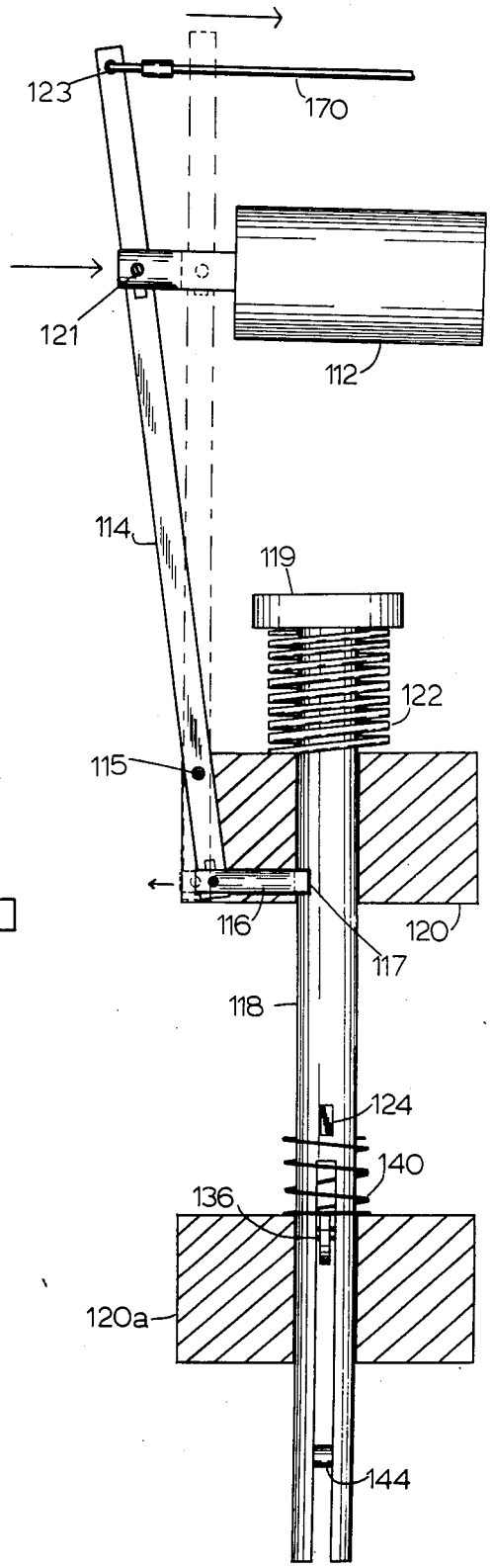
FIG. 8 is a front sectional view of the trigger device showing the mechanism for disengaging the release pin.

The launcher housing 110 houses the mechanisms shown in FIGS. 6–8. A pair of bearings 120 and **120*a*** are rigidly secured to the launcher housing. A substantially vertical shaft 118 is slidably mounted in these bearings. Any other functionally equivalent actuation means may be substituted for the slidably mounted shaft. In the preferred embodiment shaft 118 is a rod of circular cross section. The substantially horizontal arm 124 is rigidly connected to shaft 118 at a point between the two bearings. For example, arm 124 can be of rectangular cross section, arm 124 being arranged in a corresponding bore of rectangular cross section which passes through shaft 118 in a direction transverse to the shaft axis. The top end of shaft 118 is provided with a part which extends radially beyond the radius of the shaft, thereby forming a flange 119. A spring 122 (or any other functionally equivalent spring means) is arranged between the flange 119 and the upper bearing 120. A second spring (or any other functionally equivalent spring means) 140 is arranged between arm 124 and lower bearing 120*a*.

It is understood that each bearing 120, 120*a* has a bore in which shaft 118 is slidably seated. In addition, bearing 120*a* has a slot for receiving the retaining hook 136, which is provided with a detent. The retaining hook 136 is rotatably coupled to bearing 120*a* by means of pivot pin 142. Retaining hook 136 must extend radially beyond the periphery of the bearing so that it will be able to hook onto the marker buoy housing, as described below, when hook 136 is in its first position, as depicted in FIG. 6.

The shaft 118 is forked or bifurcated at its lower end, i.e. has a longitudinal slot which substantially bisects the lower portion of the shaft. Retaining hook 136 extends through this slot. The two forks of the shaft are rigidly coupled by means of pin 144 (see FIG. 8). Shaft 118 additionally has a notch or groove 117 (or any other functionally equivalent latching means) in which release pin 116 (or any other functionally equivalent trigger means) is removably inserted when pin 116 and shaft 118 are in their respective first positions, as shown in FIG. 8.

Release pin 116 is connected to one end of a lever 114, which lever is rotatably coupled to bearing 120 by way of pivot pin 115. Lever 114 is connected at point 123 on its other end to lanyard 170 and at point 121 between points 115 and 123 to the armature of a solenoid 112.

Figure 9:
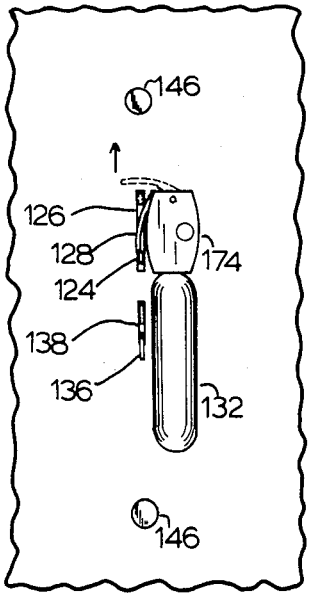
FIG. 9 is a cutaway view of the interior wall of the marker buoy housing showing the means of activating the $CO_2$ inflation assembly.

As best seen in FIG. 9, arm 124 extends through a keyway 126 formed in the rear wall of marker buoy housing 148. A $CO_2$ inflation assembly 174 is mounted on the rear wall of marker buoy housing 148. A cartridge 132 containing $CO_2$ gas is coupled to the inflation assembly. In the ready condition, arm 124 rests against a lever 128 of the inflation assembly. The alignment pins 146 of the launcher housing 110 engage corresponding bores formed in the rear wall of the marker buoy housing 148. Finally, the retaining hook 136 extends through a keyway 138 of the marker buoy housing.

Figure 10:
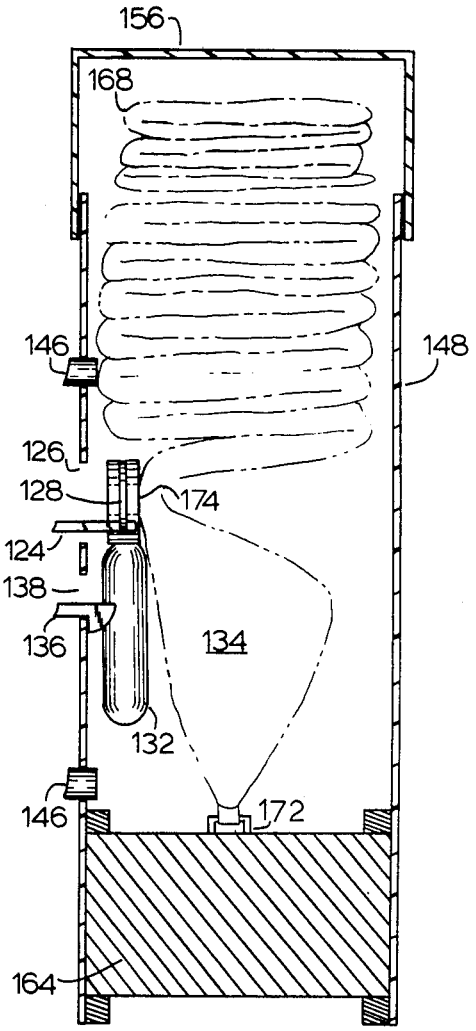
FIG. 10 is a side sectional view of the marker buoy housing.

As shown in FIG. 10, a weight 164 is securely mounted in the bottom portion of the marker buoy housing 148. Weather cap 156 is loosely fitted on the top portion of marker buoy housing 148. The chamber between the weather cap and the weight is occupied by the $CO_2$ inflation assembly and a deflated folded marker buoy 134, which is coupled to hook 172 on weight 164. A drogue 168 is folded and stacked on top of the folded marker buoy. A light 166 may be secured to the end of the marker buoy 134, as shown in FIG. 5.

Figure 1:
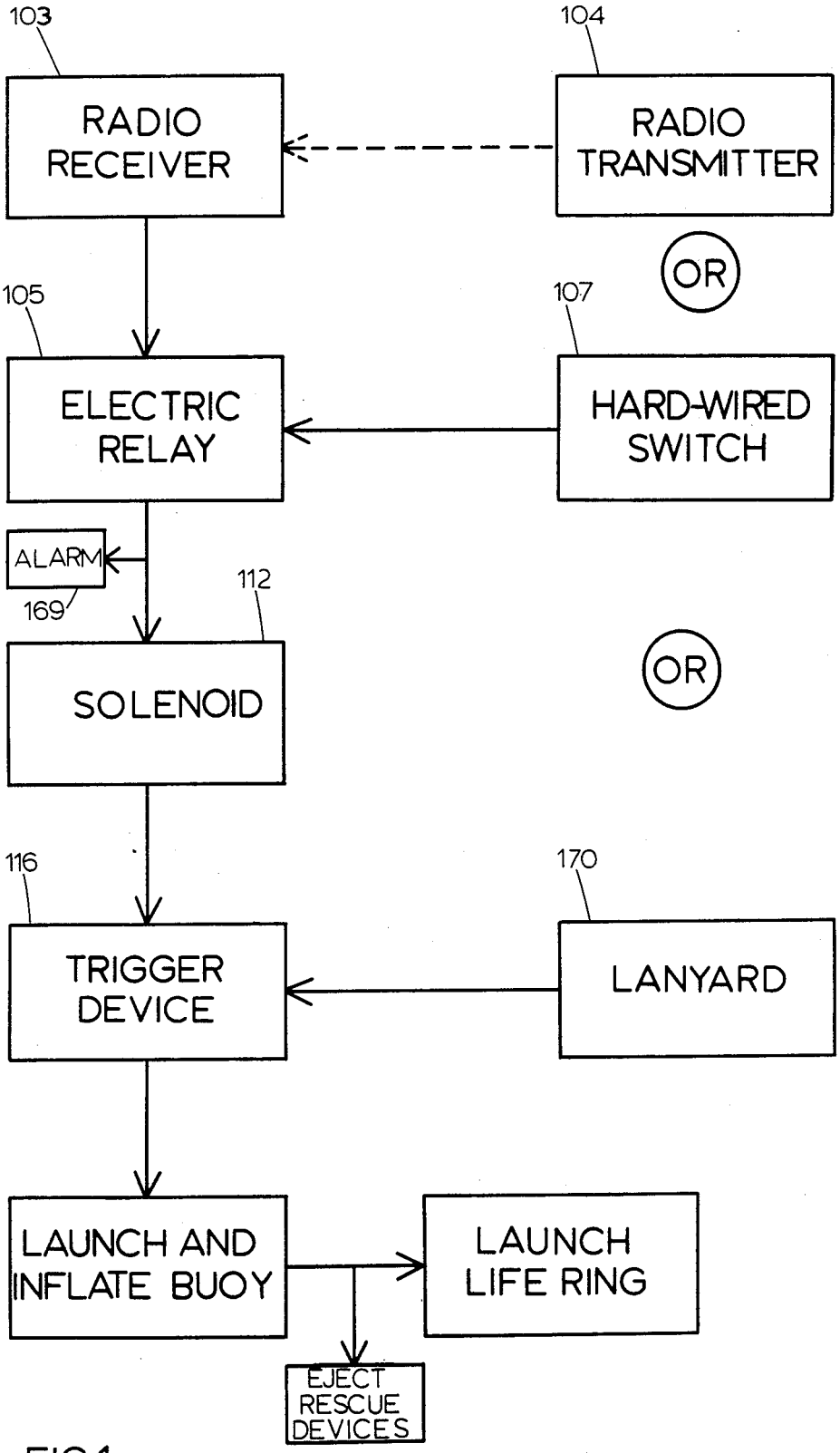
FIG. 1 is a block diagram showing operation of the apparatus.

An electric relay 105 is connected to solenoid 112 (see FIG. 1). The relay is in turn connected to radio receiver 103. Optionally, relay 105 is also connected to a hard-wired switch 107.

Figure 2:
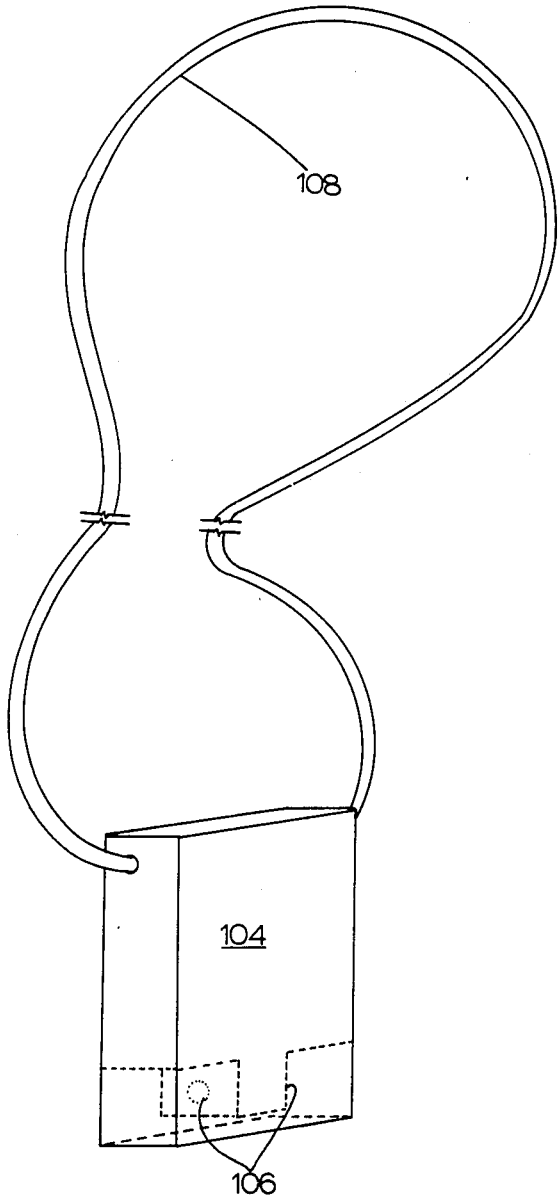
FIG. 2 shows the portable transmitter.

The invention operates as follows: when the individual 102 wearing the transmitter 104 falls into the water (FIG. 3), the transmitter is immersed. The conductivity of the water across the contacts 106 closes the circuit, activating the transmitter. Necklace 108 (FIG. 2), in which the antenna is incorporated, transmits radio signals to the receiver 103 in the launcher housing 110. The necklace can be made of buoyant material to ensure placement of the antenna on the surface of the body of water. The receiver activates an electric relay 105 which energizes electric solenoid 112 (FIG. 8). Solenoid 112 actuates lever 114, which disengages release pin 116 from a notch formed in shaft 118, i.e. moves pin 116 from its first position to its second position. The arrows in FIG. 8 show the directions of movement of the pin of solenoid 112 and the release pin 116 as lever 114 rotates about pivot 115 mounted on bearing 120. Shaft 118, which is mounted in bearings 120 and 120a, travels in the direction of the arrow in FIG. 7, propelled by spring 122 in response to disengagement of release pin 116, until it reaches a second position, as shown in FIG. 7. Arm 124, projecting at right angles relative to shaft 118, protrudes through the wall of the launcher housing 110, where it protrudes into keyway 126 of marker buoy housing 148 and rests against lever 128 of the $CO_2$ inflation assembly 174 (FIGS. 9 and 10). The $CO_2$ inflation assembly is of the commercially available type and is mounted on an inner wall of the marker buoy housing 148 such that gas released from cartridge 132 will inflate marker buoy 134. Upward movement of shaft 118 from its first position to its second position causes arm 124 to push lever 128 upward, thereby puncturing the gas cartridge and initiating buoy inflation. Shaft 118 is forked in its lower portion (see FIG. 8) and retaining hook 136, which is mounted on shaft bearing 120a, extends between the prongs of the fork and protrudes through the wall of the launcher housing into keyway 138 of the marker buoy housing, where in its first position it hooks on the edge of keyway 138, thereby retaining the marker buoy housing 148 against the launcher housing 110 (see FIG. 10). Spring 140 on the forked end of shaft 118 exerts pressure on the retaining hook 136, keeping it in the first, i.e. locked position. As shaft 118 continues to travel upwardly, the compression of spring 40 by arm 124 is released, thereby allowing retaining hook 136 to pivot on pin 142 when pin 144 contacts and urges retaining hook 136 upward toward its second position. Retaining hook 136 is thus moved into the release position (see FIG. 7). Alignment pins 146 (FIG. 5) protrude from the launcher housing 110 into corresponding holes in marker buoy housing 148, thereby keeping the marker buoy housing stationary until the moment of deployment. After movement of retaining hook 136 to the second, i.e. release position, the marker buoy housing is free to be launched from the launcher housing. In the stowed position, launcher arm 150 is retained behind the marker buoy housing. Torsion springs 152 are mounted on launcher arm 150 at pivot points 154. Launcher arm 150 is now free to pivot away from the launcher housing 110. Marker buoy housing 148 is thereby shown into the water, pushed by the spring-loaded launcher arm. As housing 148 is released, the retaining effect exerted by weather cap 156 and tongue 158 on life ring 160 is released, allowing the life ring to be launched simultaneously. Weather cap 156 is loosely fitted to marker buoy housing 148 and falls away or is pushed off by the inflating and emerging marker buoy. The weather cap is attached to line 162, which links the life ring 160 and the marker buoy 134. Inflation of the float is completed and weight 164, joined to the buoy 134 by coupling 172, causes the marker buoy to assume an upright position in the water. Buoy 134 is fitted with the water-activated light 166, which is lit upon contact with the water. The marker buoy housing may also contain drogue 168 and other small rescue devices which are ejected by the inflating buoy. An audible alarm 169 may also be activated aboard the vessel when the system is deployed. Alternative modes of deployment of this apparatus (see FIG. 1) are by manually pulling on a lanyard 170 which is attached to lever 114 (see FIG. 8), thereby eliminating operation of the radio receiver and the solenoid, or by control of a remote hard-wired switch on the vessel, thereby eliminating operation of the radio transmitter and receiver, but not the solenoid. This system could be easily adapted to launch various forms of personal flotation devices.

The foregoing description of the preferred embodiment is presented for illustrative purposes only and is not intended to limit the scope of the invention as defined in the appended claims. Modifications may be readily effected by one having ordinary skill in the art without departing from the spirit and scope if the inventive concept herein disclosed.

What is claimed is:

1. An automatic apparatus for launching rescue equipment in response to an emergency condition, said automatic apparatus comprising a launcher housing, a launcher arm rotatably mounted on said launcher housing, first spring means for urging said launcher arm to rotate relative to said launcher housing, an actuation means displaceably mounted in said launcher housing and having a first latching means provided thereon, a trigger means adapted to engage said first latching means when said actuation means and said trigger means are in respective first positions, a second spring means for urging said actuation means toward a second position in response to said trigger means being displaced to a second position whereat said trigger means is disengaged from said first latching means, a marker buoy housing capable of being releasably mounted on said launcher housing, and coupling means connected to said launcher housing for releasably coupling said launcher housing and said marker buoy housing, said coupling means comprising second latching means displaceable between a first position at which said second latching means couples said launcher housing and said marker buoy housing and counteracts the urging of said launcher arm and a second position at which said second latching means releases said marker buoy housing from said launcher housing and does not counteract the urging of said launcher arm, said second latching means being displaced from its first position toward its second position by said actuation means when said actuation means reaches it second position.

2. The automatic apparatus as defined in claim 1, wherein said rescue equipment comprises a marker buoy capable of being secured to and contained by said marker buoy housing and a life ring capable of being supported by said marker buoy housing, said life ring being adapted to be held securely in place by said marker buoy housing and said launcher arm when said launcher housing, said marker buoy housing and said life ring are assembled in a ready condition, such that said life ring and marker buoy housing can be launched by rotation of said launcher arm in response to release of said marker buoy housing by said latching means.

3. The automatic apparatus as defined in claim 2, wherein said marker buoy housing comprises a cap having an extension means connected thereto, said extension means being arranged to block displacement of said life ring in the direction of launching when said life ring is mounted on said marker buoy housing and said marker buoy housing is coupled to said launcher housing by said latching means.

4. The automatic apparatus as defined in claim 2, further comprising means for manually disengaging said trigger means.

5. The automatic apparatus as defined in claim 2, further comprising a compressed gas inflation assembly rigidly mounted inside said marker buoy housing, said inflation assembly having a release lever for releasing compressed gas from a cylinder by way of an outlet, said outlet communicating with an inlet of said inflatable marker buoy.

6. The automatic apparatus as defined in claim 5, further comprising a weight mounted inside said marker buoy housing and a fastening means for connecting said marker buoy to said weight.

7. The automatic apparatus as defined in claim 5, wherein said actuation means comprises a rod slidably arranged in first and second bearing means, and an arm rigidly connected to said rod and extending radially therefrom, said arm engaging said release lever of said inflation assembly during displacement of said rod from said first position toward said second position.

8. The automatic apparatus as defined in claim 1, wherein said second latching means prevents displacement of said marker buoy housing in the direction of launching when said marker buoy housing and said launcher housing are coupled thereby.

9. The automatic apparatus as defined in claim 1, wherein said coupling means further comprises first and second support members rigidly connected to said launcher housing, and said marker buoy housing comprises first and second bores for respectively receiving said first and second support members, said support members respectively cooperating with said bores to prevent displacement and rotation of said marker buoy housing relative to said launcher housing in a plane substantially transverse to the direction of marker buoy housing launching.

10. The automatic apparatus as defined in claim 9, wherein said first and second support members each comprise a rigid pin.

11. The automatic apparatus as defined in claim 1, further comprising a means for receiving a radio alarm signal and a trigger disengagement means electrically connected to said radio receiver means and mechanically connected to said trigger means, said trigger disengagement means displacing said trigger means from said first position to said second position in response to receipt of said radio alarm signal.

12. The automatic apparatus as defined in claim 11, wherein said radio receiver means comprises a radio receiver and a relay means connected between said radio receiver and said trigger actuation means, and further comprising a transmitter means capable of transmitting said radio alarm signal in response to immersion of said transmitter means in water, and fastening means for fastening said transmitter means to a person.

13. The automatic apparatus as defined in claim 1, wherein said actuation means comprises a rod slidably arranged in first and second bearing means and rigidly mounted in said launcher housing, said first latching means being formed as a groove in said rod which is capable of engaging said trigger means, said second latching means being pivotably connected to one of said bearings, said rod being bifurcated by a slot along part of its axial length, said slot being formed to allow passage of said second latching means therethrough, said bifurcated ends of said rod being securely connected by a pin, said pin being axially positioned such that said pin engages said second latching means when said actuation means reaches said second position.

* * * * *